US006497420B2

(12) United States Patent
Ricci

(10) Patent No.: US 6,497,420 B2
(45) Date of Patent: Dec. 24, 2002

(54) SKATE WITH ADJUSTABLE SIZE

(75) Inventor: Marco Ricci, Montebelluna (IT)

(73) Assignee: Roces S.R.L., Montebelluna (IT)

( * ) Notice: Subject to any disclaimer, the term of this patent is extended or adjusted under 35 U.S.C. 154(b) by 0 days.

(21) Appl. No.: 09/809,737

(22) Filed: Mar. 13, 2001

(65) Prior Publication Data

US 2001/0028152 A1 Oct. 11, 2001

(30) Foreign Application Priority Data

Apr. 7, 2000 (IT) ..... TV000018 U

(51) Int. Cl.[7] ..... A63C 1/22; A63C 17/02; A43B 3/26

(52) U.S. Cl. ..... 280/11.16; 280/11.221; 36/97

(58) Field of Search ..... 280/11.16, 11.26, 280/11.27, 11.32, 11.33, 11.34, 616, 617, 7.13, 11.12, 600, 11.19, 11.221; 36/97, 117.7, 117.8

(56) References Cited

U.S. PATENT DOCUMENTS

| | | | | | |
|---|---|---|---|---|---|
| 480,051 | A | * | 8/1892 | Warner | 280/11.16 |
| 1,535,422 | A | * | 4/1925 | Larsen | 280/11.26 |
| 2,170,162 | A | * | 8/1939 | Segal | 280/11.26 |
| 2,245,769 | A | * | 6/1941 | Flamm | 280/11.19 |
| 3,007,706 | A | * | 11/1961 | Pullen | 280/11.26 |
| 3,309,098 | A | * | 3/1967 | Parker | 280/11.26 |
| 3,993,318 | A | * | 11/1976 | Rothmayer | 280/11.26 |
| 5,498,009 | A | * | 3/1996 | Young | 280/11.12 |
| 5,678,833 | A | | 10/1997 | Olson et al. | |
| 5,794,362 | A | | 8/1998 | Polk, III et al. | |
| 6,438,872 | B1 | * | 8/2002 | Chil et al. | 36/97 |

FOREIGN PATENT DOCUMENTS

| | | | | |
|---|---|---|---|---|
| DE | 3150098 A | * | 7/1982 | 280/11.16 |
| EP | WO 00 03614 A | | 1/2000 | |
| FR | 2623724 A | * | 6/1989 | 280/600 |
| FR | 2719198 A | | 11/1995 | |

* cited by examiner

*Primary Examiner*—Brian L. Johnson
*Assistant Examiner*—G B Klebe
(74) *Attorney, Agent, or Firm*—R. Neil Sudol; Henry Coleman; William Sapone

(57) ABSTRACT

A skate with adjustable size has a toe unit and a heel unit. The heel unit is slidingly associated with the toe unit through sliders and a fastener constituted by a screw is adapted to adjust and lock the mutual axial position of the heel unit with respect of the toe unit. The fastener is operated through a folding lever associated with the skate.

20 Claims, 5 Drawing Sheets

SKATE WITH ADJUSTABLE SIZE

BACKGROUND OF THE INVENTION

1. Field of the Invention

The present invention relates to a skate with adjustable size.

Roller skates provided with a shoe with adjustable size are known and offer unquestionable advantages, especially if used for children, not only from the economic standpoint but also from the point of view of the practicality and convenience of being able to use a product for a much longer period.

Moreover, a sports shoe with adjustable size can be used by several people, even if they have different foot sizes, thus allowing to hire out skates even to users having different foot sizes.

2. Description of the Prior Art

U.S. Pat No. 5,678,833 discloses a skate with in-line wheels whose length is adjustable and which has a rigid supporting frame for a plurality of wheels arranged in-line, a shell which includes a toe unit and a heel unit, and a first means, formed in the heel unit, for coupling to the frame. The heel unit has a sole slidingly connected to the base of the toe unit by means of a second engagement means.

The second engagement means comprises a screw, for the removable coupling of the base of the toe unit to a part of the frame, thus allowing the toe unit to slide with respect to the heel unit in a direction which is substantially parallel to the longitudinal axis of the skate. A cuff is connected to the heel unit by means of a pair of studs. The studs are connected to a sliding means provided on the two side walls of the toe unit.

Such prior art skate has a rather complex structure which increases the manufacturing costs. Moreover, adjusting the size of the skate is not a straightforward operation. The adjustment in fact requires some time, because it is necessary to first loosen the screw by means of a tool and then put the skate on to find the exact position of the heel unit with respect to the toe unit. Then, it is necessary to tighten the screw again, with the possibility of unwanted changes in the position of the various members.

A further drawback of such prior art adjustable skate is the lack of any visual indication of the size or length used: this entails that a user who has already performed a size adjustment cannot rapidly restore the exact original position but has to perform the same complicated procedures performed the first time.

IT-1,257,603 discloses a skate with in-line wheels comprising a monolithic shell and wheel support.

The shell is open upward and to the rear; a quarter is selectively and slidingly associated with the shell at the rear and a tongue is associated with the shell in an upward region.

The quarter has a rear grip handle for the user and has a brake which can be associated by snap action with a frame which is in turn associated with the support.

By acting on a pair of screws it is possible to vary the size of the skate by changing the axial position of the quarter with respect to the shell.

This type of adjustable-size sports shoe, however, has the main drawback that the adjustment of the skate size is obtained by moving the rear part of the shoe therefore shifting the position of the heel, and consequently there is an undesirable and disadvantageous variation of the position of the center of gravity with respect to the wheels.

That is an important drawback because almost all the weight of the body is transmitted to the ground through the resting region that corresponds to the heel, and a displacement of the heel can lead to adaptation difficulties in skating.

A further drawback of the above-described prior art skate is its complicated structure required to achieve both lateral support and mutual sliding of the various members.

A further drawback of the above-described prior art skate is that the size may be varied only by discrete amounts which approximately correspond to one foot size each and therefore the user may be unable to precisely adapt the skate to the size of his or her foot, having to do with an approximate adjustment by choosing the next larger size with respect to his or her exact size.

Other conventional skates with adjustable size have the drawback that the adjustment devices are arranged along the sides of the skate, in positions which often interfere with sports practice by partially protruding from the structure of the frame.

SUMMARY OF THE INVENTION

The aim of the present invention is to overcome the above-described problems, eliminating the drawbacks of the cited prior art, by providing a skate with adjustable size, particularly an in-line roller-skate or an ice skate, whose size can be adjusted simply and straightforwardly while allowing optimum sports practice.

An important object of the invention is to provide a skate which provides for a substantially continuous adjustment of the size, so that the user can adapt the shoe to the exact dimensions of his or her foot and so as to also achieve optimum balance.

Another object is to provide a skate which provides for an immediate visualization of the size selected by the user.

Another object is to provide a skate which does not have protruding members which may limit its functionality during sports practice.

Another important object is to provide a skate which can be easily adjusted by the user without requiring additional tools or instruments.

Another object is to provide a skate which is simple and intuitive to use.

A further object of the invention is to provide a skate with adjustable size which is not substantially aesthetically different from conventional non adjustable skates.

A further object is to provide a structurally simple skate which can be produced at low manufacturing costs.

The above aim and objects, as well as other objects that will become better apparent hereinafter, are achieved by a skate with adjustable size as claimed in the appended claims.

BRIEF DESCRIPTION OF THE DRAWINGS

Further characteristics and advantages of the invention will become better apparent from the following detailed description of a particular embodiment thereof, illustrated only by way of non-limitative example in the accompanying drawings, wherein.

DESCRIPTION OF THE PREFERRED EMBODIMENTS

Figure 1:
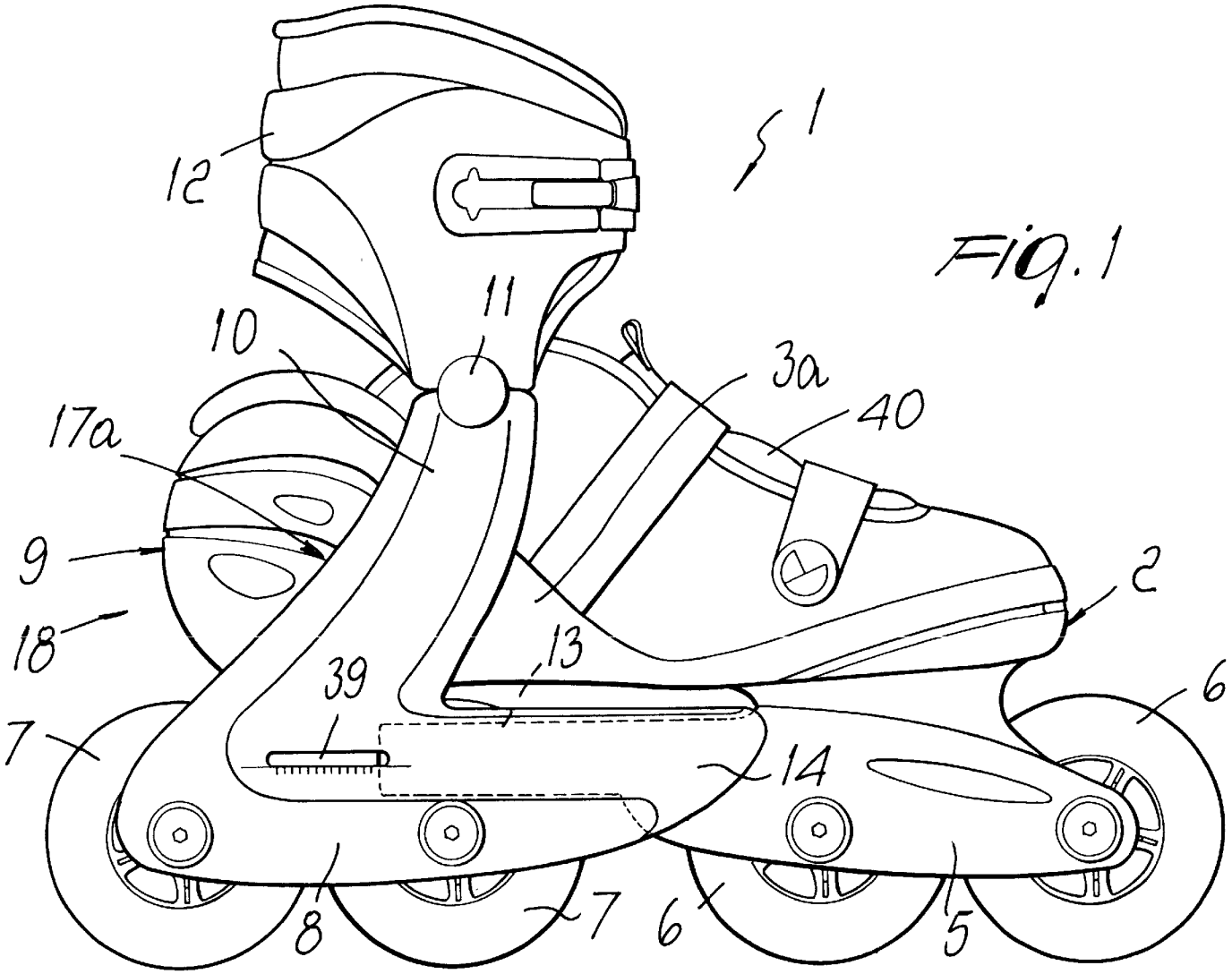
FIG. 1 is a side view of the skate according to the invention, shown in the assembled condition.
Figure 2:
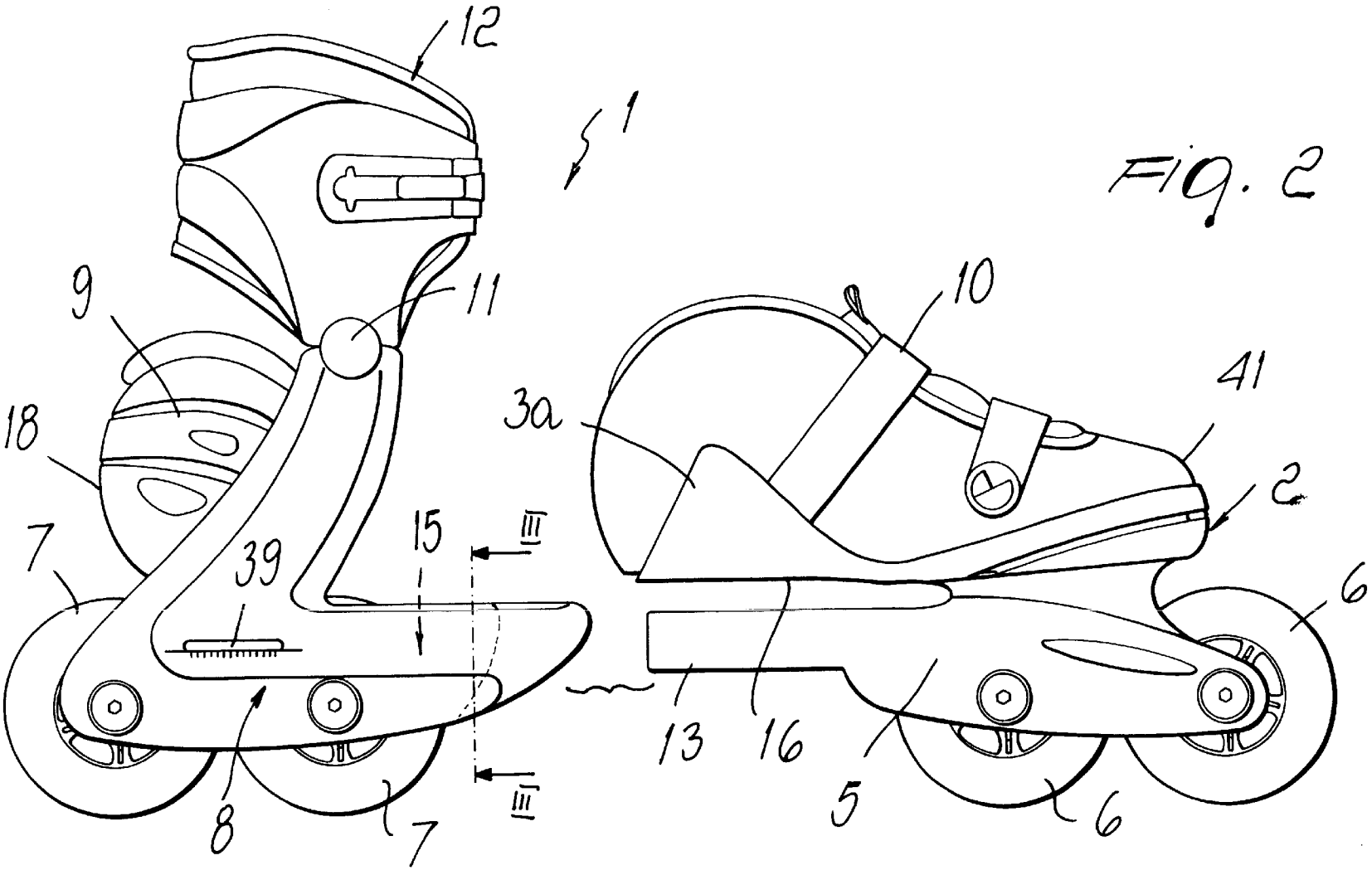
FIG. 2 is a side view of the skate according to the invention, shown before being assembled.
Figure 3:
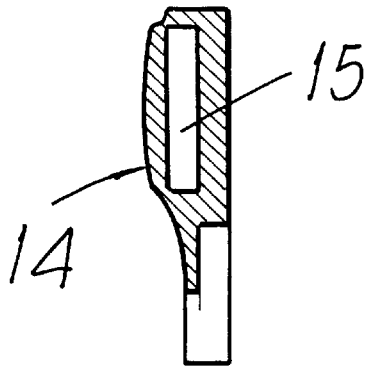
FIG. 3 is a sectional front enlarged view of the sliding means.
Figure 7:
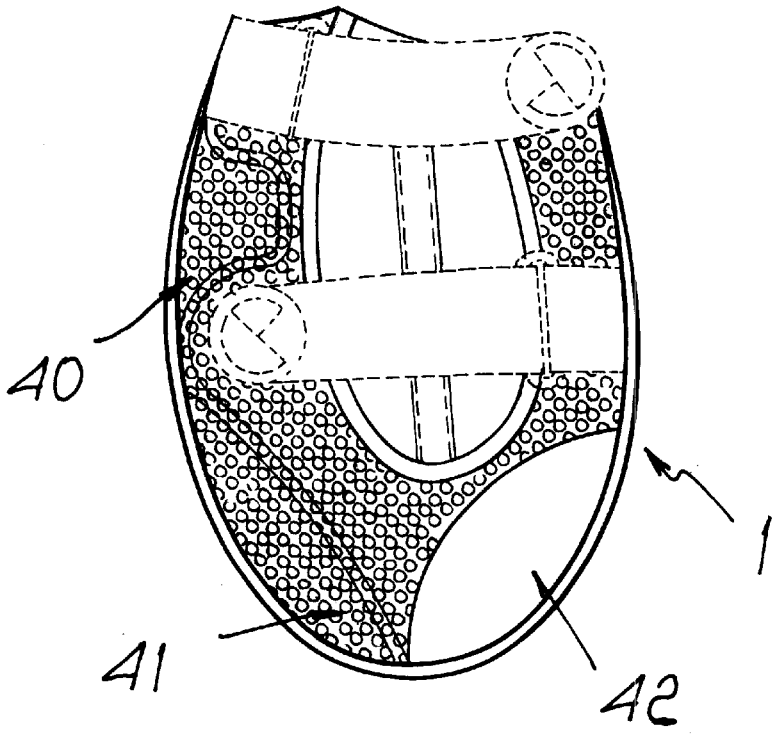
FIG. 7 is a top view of an innerboot, or upper, usable in the skate according to the invention, provided with a transparent region.
Figure 4:
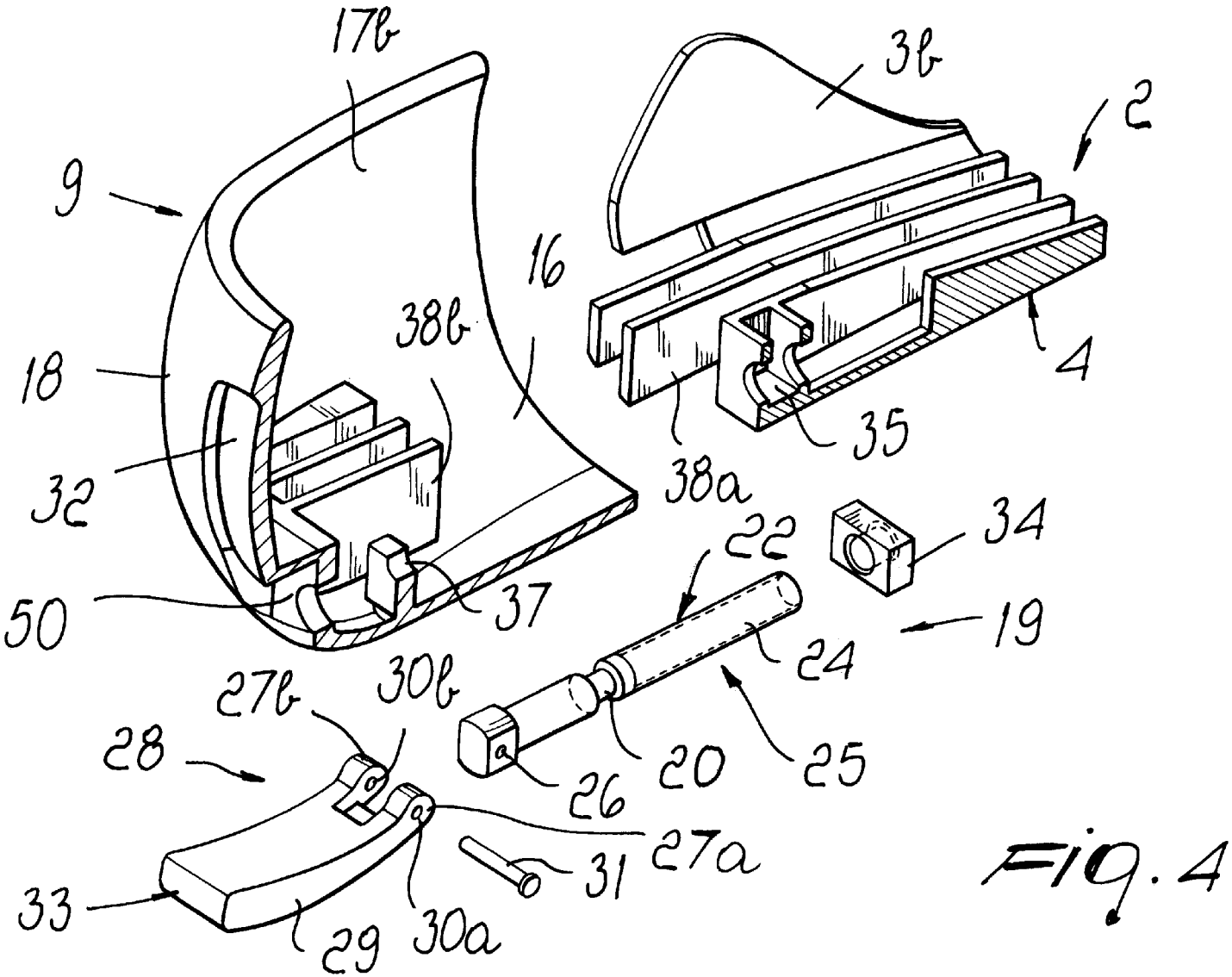
FIG. 4 is an exploded perspective partial view of the connection and adjustment means which can be inserted in the heel unit and in the toe unit.

With reference to the above-cited figures, the numeral 1 designates an in line roller skate.

The skate 1 comprises a toe unit, designated by the reference numeral 2, having two wings 3*a* and 3*b*, laterally and to the rear. Wings 3*a* and 3*b* are preferably slightly curved and protrude upward with respect to a first base member 4.

The toe unit 2 is associated with a first support 5 having a transverse cross-section in the shape of an inverted U in order to support a first pair of in-line wheels, designated by the reference numeral 6.

A second pair of in-line wheels, designated by the reference numeral 7, are supported by a second support 8 which is associated with a heel unit 9.

The second support 8 has two wings 10 which are approximately L-shaped and protrude upward. Pivots 11 are associated with the ends of the wings for pivoting a cuff 12.

A sliding means is provided at the facing ends of the first and second supports 5 and 8 for the mutual longitudinal sliding of the toe unit 2 and the heel unit 9. The sliding means comprises a first pair of side portions 13 and a second pair of side portions 14 which respectively protrude to the rear from the first support 5 and in front of the second support 8, in an approximately horizontal direction.

The toe unit 2 can slide with respect to the heel unit 9 because the first pair of side portions 13 are slidingly engaged in shaped first seats 15 provided, internally and axially, in the side portions 14.

The heel unit 9 comprises a second base member 16, which is in contact with the second support 8, and two side walls 17*a* and 17*b* which protrude upward and are curved and blended, to the rear, with a rear wall 18 which is also curved.

The second base member 16 has a fastener means 19 for connecting and adjusting the mutual axial position of the toe unit 2 and the heel unit 9. Wings 3*a* and 3*b*, of the toe unit 2, slide on the internal lateral surface of the pair of side walls 17*a* and 17*b* of the heel unit 9, and the base 4 rests and slides on the base 16.

The fastener means 19 comprises a mechanical connecting member, such as for example a screw, designated by the reference numeral 20, which is arranged so that its axis is parallel to the longitudinal axis of the skate and has, at one end, a head 21 which is shaped like a parallelepiped.

The head 21 protrudes to the rear from the heel unit, at an abutment surface 50, which is formed on the outer surface of the rear wall 18 and is perforated for the passage of a stem 22, which protrudes toward the toe unit 2.

The stem 22 is constituted by a first smooth part 23, which is adjacent to the head 21, and by a second threaded part 24, which is arranged opposite the head 21. A recess 25 is formed between the first smooth part 23 and the second threaded part 24.

The head 21 has a first transverse through hole 26 and is arranged between a third pair of tabs 27*a* and 27*b*, which are mutually parallel and are provided at a first end 28 of a folding lever 29, so that the first through hole 26 lies along the same axis as a pair of second through holes 30*a* and 30*b*, which are formed respectively in the third pair of tabs 27*a* and 27*b*.

In this manner, the screw 20 can be associated with the folding lever 29, by means of a pivot 31 which can slide with an interference fit within the first and second through holes 26, 30*a* and 30*b*.

The folding lever 29 can thus rotate about the pivot 31 and is curved so that it can be accommodated in a complementarily shaped second seat 32 which is formed in the rear wall 18 of the heel unit 9.

When the folding lever 29 is lowered so that its second end 33 is free and protrudes to the rear of the heel unit 9, it allows the user to turn the screw 20 about its own axis.

This produces the sliding, along the second threaded part 24 of the stem 22, of a complementarily threaded nut 34 which is retained within a complementarily shaped seat 35 which is formed at one end of the toe unit 2.

This activates the translatory motion of the toe unit 2 with respect to the heel unit 9, since the screw 20 is locked, with respect to an axial movement, by the interference of the side walls of the recess 25 with the facing surfaces of a protrusion 36 which protrudes upward from the second base member 16 and has a complementarily shaped third seat 37 for accommodating the recess 25.

The sliding of the toe unit 2 with respect to the heel unit 9 is also facilitated by the presence of first and second guide members 38*a* and 38*b* which are formed respectively in the first base member 4 and in the second base member 16.

A graduated viewing port 39 is provided laterally to the second support, at one or both of the second side portions 14. The viewing port 39 is constituted by a slot or by a transparent member included in the second tab.

The viewing port 39 is arranged so as to allow to view the free end of the respective first side portion 13, so as to allow the user both to easily read the size that is set and to straightforwardly perform adjustment according to the intended size.

The skate 1 comprises an innerboot, or an upper, designated by the reference numeral 40, which is associated with the toe unit 2 and has at least one transparent or open region 42, at a toe region 41. The transparent or open region 42 allows viewing of the toes, thus allowing the user, particularly a child, to easily and intuitively adjust the size of the shoe.

Figure 5:
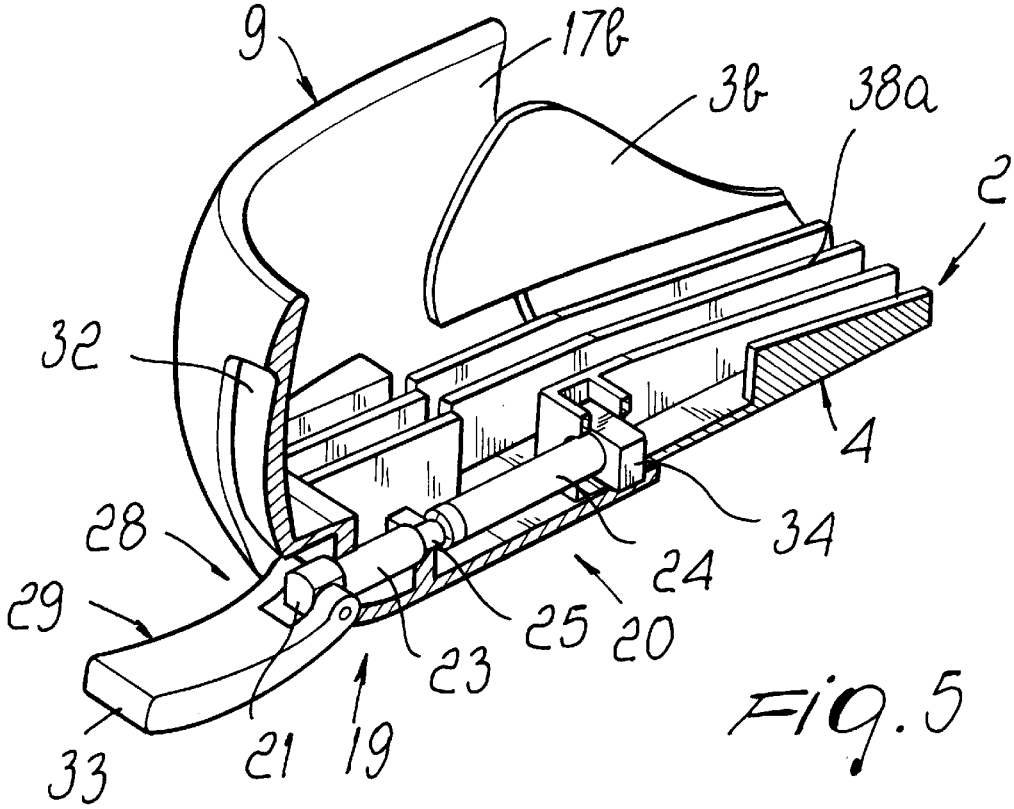
FIG. 5 is a perspective view of the connection and adjustment means inserted in the heel unit and in the toe unit.
Figure 6:
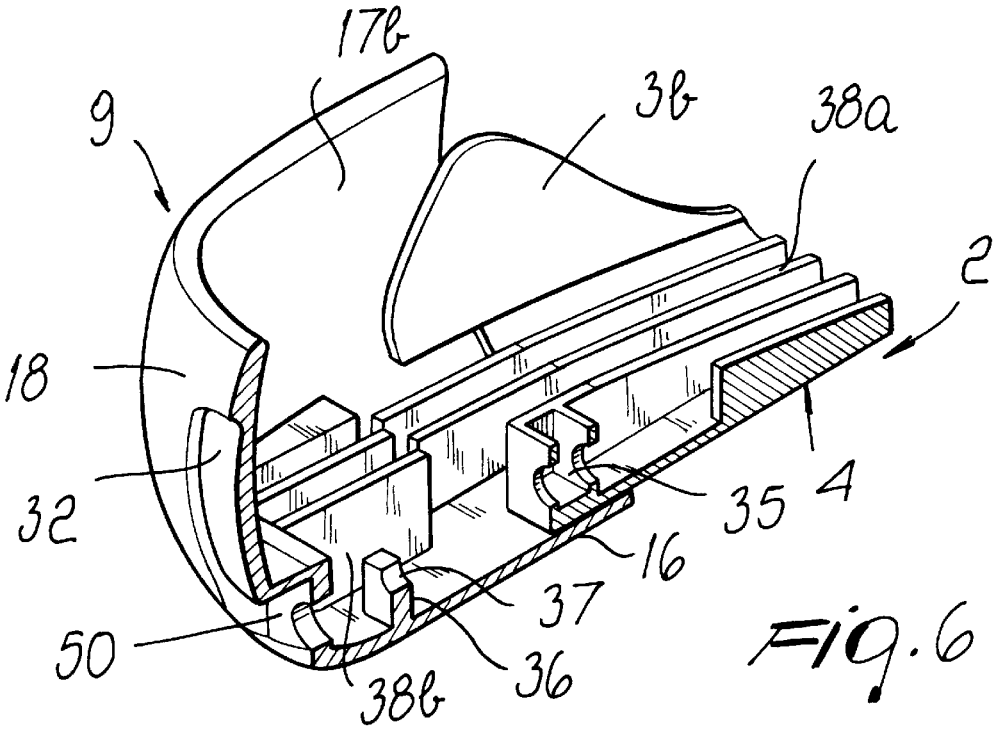
FIG. 6 is a perspective view, similar to the preceding one, of the heel unit and of part of the toe unit, without the connection and adjustment means.

The operation of the skate is as follows: with particular reference to FIG. 5, the user can vary the length of the skate 1 simply by lowering the folding lever 29 and acting thereon so as to turn the screw 20.

Since the nut 34 is prevented from turning in either direction because it is arranged in the seat 35, the rotation of the screw 20 entails the advancement or retraction of the toe unit 2 with respect to the heel unit 9, depending on the direction of the rotation of the screw.

The screw is in fact prevented from moving axially in both directions by virtue of the interference between the lateral walls of the recess 25 and the walls of the protrusion 36.

The translatory motion of the toe unit 2 with respect to the heel unit 9 is guided by the two wings 3*a* and 3*b*, which can slide along the internal surfaces of the two side walls 17*a* and 17*b,* by the first and second guiding members 38*a* and 38*b,* which can slide with respect to each other, and by the interaction of the first and second pairs of side portions 13 and 14.

Once the intended adjustment has been reached, the folding lever can be returned into the second seat 32 and the selected size can be read at the viewing ports 39.

It has been observed that the invention has achieved the intended aim and objects, a skate having been provided whose size can be adjusted simply and straightforwardly.

The skate according to the invention is also perfectly suitable for a normal sports practice and its performance is similar to conventional non adjustable skates.

The skate according to the invention is susceptible of numerous modifications and variations, within the scope of the appended claims.

The materials used, as well as the dimensions that constitute the individual components of the invention, may of course be more pertinent according to specific requirements.

What is claimed is:

1. A skate with adjustable size, comprising:

a toe unit;

a heel unit;

slider means on said toe unit and said heel unit for slidingly connecting said heel unit to said toe unit; and fastener means for enabling an adjustment in an axial position of said toe unit and said heel unit relative to one another and for releasably locking said toe unit and said heel unit to one another, said fastener means including a screw having a longitudinal axis parallel to a longitudinal axis of the skate, said screw including a head and an at least partially threaded stem, said fastener means further including a complimentarily threaded nut operatively connected to said stem, said head protruding from said heel unit at an abutment surface formed on an outer surface of said heel unit, said fastener means additionally including a folding lever pivotably connected to said head, said stem including a smooth part adjacent to said head and a threaded part opposite said head, said stem being formed with an annular recess disposed between said smooth part and said threaded part.

2. The skate according to claim 1, wherein said toe unit has two wings, to the side and to the rear, said wings being slightly curved and protruding upward with respect to a first base member, which rests slidingly on a second base member formed in said heel unit.

3. The skate according to claim 2, wherein said heel unit comprises said second base member, from which two side walls protrude upward, said walls being curved and blended to the rear with a rear wall which is also curved, said pair of wings of said toe unit resting and sliding on the internal lateral surface of said pair of side walls.

4. The skate according to claim 3, further comprising a wheel support connected to said heel unit, wherein said wheel support is laterally provided with two wings which are approximately L-shaped and protrude upward, respective pivoting studs for a cuff being associated with their ends.

5. The skate according to claim 3, wherein said wheel support is a second support, further comprising a first support connected to said toe unit for rotatably carrying wheels, said slider means comprising two first side portions and two second side portions that respectively protrude to the rear from said first support and in front of said second support, in an approximately horizontal direction.

6. The skate according to claim 5, wherein said second side portions have, internally and axially, respective complementarily shaped seats for positioning, so as to allow axial sliding, said first side portions, and therefore said toe unit, with respect to said heel unit.

7. The skate according to claim 6, wherein said head is shaped like a parallelpiped.

8. The skate according to claim 1, wherein said head is provided with a transverse first through hole and can be arranged between a pair of mutually parallel tabs which are provided on said folding lever at a first end thereof.

9. The skate according to claim 8, wherein said first through hole is arranged along the same axis as a pair of second through holes which are formed in said pair of tabs.

10. The skate according to claim 9, wherein said screw is associated with said folding lever, by means of a pivot which can slide with an interference fit within said first and second through holes.

11. The skate according to claim 10, wherein said folding lever, which can rotate about said pivot, is curved in order to be retractably arranged in a complementarily shaped seat formed in a rear wall of said heel unit.

12. The skate according to claim 11, wherein said folding lever, when lowered so that its second free end protrudes to the rear of said heel unit, allows the user to turn said screw about its own axis.

13. The skate according to claim 12, wherein said nut is retained within a complementarily shaped seat which is formed at one end of said toe unit so as to prevent its translatory motion and rotation with respect to said toe unit.

14. The skate according to claim 13, wherein said screw is locked, with respect to an axial movement, by an interference of side walls of said recess with facing surfaces of a protrusion which protrudes upward from a base member of said heel unit and has a complementarily shaped seat for accommodating said recess.

15. The skate according to claim 14, wherein said base member is a first base member and said toe unit includes a second base member, a rotation of said screw resulting in a translatory motion of said toe unit with respect to said heel unit, said translatory motion being facilitated by first and second guide members which are formed respectively in said first and second base members.

16. The skate according to claim 15, wherein said heel unit is provided with a wheel support, further comprising a viewing port provided laterally to said wheel support, said viewing port comprising a slot or transparent member.

17. The skate according to claim 16, wherein said slider means includes a first side portion on said toe unit and a second side portion on said heel unit, said first side portion and said second side portion being slidingly connected to one another, said viewing port being arranged so as to allow a user to view a free end of said first side portion, so that the user can easily read a set size and straightforwardly adjust said skate to an intended size.

18. The skate according to claim 1, further comprising an innerboot or an upper associated with at least said toe unit and having at least one transparent or open region which allows a user to view his or her toes.

19. A skate with adjustable size, comprising:

a toe unit;

a heel unit;

cooperating slide elements on said toe unit and said heel unit for slidingly connecting said heel unit to said toe unit; and a fastener assembly for enabling an adjustment in an axial position of said toe unit and said heel unit relative to one another and for releasably locking said toe unit and said heel unit to one another, said fastener assembly including a screw having a longitudinal axis parallel to a longitudinal axis of the skate, said screw including a head and an at least partially threaded stem, said fastener assembly further including a complimentarily threaded nut operatively connected to said stem, said head protruding from an outer surface of said heel unit, said fastener assembly additionally including a lever pivotably connected to said head by at least one pivot pin, whereby said lever may be pivoted between a rest position adjacent to said outer surface of said heel unit and a use position extended out from said outer surface.

20. A skate with adjustable size, comprising:

a toe unit;

a heel unit;

cooperating slide elements on said toe unit and said heel unit for slidingly connecting said heel unit to said toe unit, said slide elements including vertically oriented plates;

a fastener assembly for enabling an adjustment in an axial position of said toe unit and said heel unit relative to one another and for releasably locking said toe unit and said heel unit to one another; and vertically oriented guide plates on said toe unit and said heel unit, different from the vertically oriented plates of said slide elements, said guide plates being interleavable with one another.

* * * * *